US008646678B2

(12) United States Patent
Miquel Pérez et al.

(10) Patent No.: US 8,646,678 B2
(45) Date of Patent: Feb. 11, 2014

(54) BASKET

(75) Inventors: Félix Miquel Pérez, Barcelona (ES); Oriol Farre Sotorra, Barcelona (ES); Beatriz Borras Palau-Ribes, Palma De Mallorca (ES)

(73) Assignee: Grupo BDEB 2006, Servicios Empresariales, S.L., Palma de Mallorca (ES)

( * ) Notice: Subject to any disclaimer, the term of this patent is extended or adjusted under 35 U.S.C. 154(b) by 362 days.

(21) Appl. No.: 12/296,753

(22) PCT Filed: Apr. 12, 2007

(86) PCT No.: PCT/EP2007/053537

§ 371 (c)(1),
(2), (4) Date: Oct. 10, 2008

(87) PCT Pub. No.: WO2007/116087

PCT Pub. Date: Oct. 18, 2007

(65) Prior Publication Data

US 2009/0121001 A1 May 14, 2009

(30) Foreign Application Priority Data

Apr. 12, 2006 (ES) ..... 200600855 U

(51) Int. Cl.
*B65D 5/46* (2006.01)
*B65D 5/02* (2006.01)

(52) U.S. Cl.
USPC ..... 229/109; 229/117.14; 229/185.1

(58) Field of Classification Search
USPC ..... 229/120.34, 120.03, 120.08, 120.05, 229/120.11, 120.16, 109, 117.14, 185.1, 229/170; 206/163, 183
See application file for complete search history.

(56) References Cited

U.S. PATENT DOCUMENTS

| | | | | |
|---|---|---|---|---|
| 1,999,664 | A | 4/1935 | Reaume | |
| 2,007,438 | A | 7/1935 | Agar | |
| 2,462,676 | A | 2/1949 | Riley | |
| 2,529,675 | A | 11/1950 | Brulin | |
| 2,739,735 | A * | 3/1956 | Anderson, Jr. | 206/169 |
| 2,747,785 | A * | 5/1956 | Fink | 229/117.14 |
| 2,841,319 | A * | 7/1958 | White et al. | 229/120 |
| 2,844,294 | A * | 7/1958 | Williams | 229/120.1 |
| 3,069,979 | A * | 12/1962 | Charles et al. | 493/136 |
| 3,722,782 | A * | 3/1973 | Collie | 229/108 |
| 4,227,640 | A * | 10/1980 | Roccaforte | 229/104 |
| 4,318,470 | A * | 3/1982 | Montealegre | 206/180 |
| 5,123,588 | A * | 6/1992 | Harris | 229/117.13 |

* cited by examiner

*Primary Examiner* — Gary Elkins
*Assistant Examiner* — Christopher Demeree
(74) *Attorney, Agent, or Firm* — Lawrence G. Fridman

(57) ABSTRACT

The basket of the present invention comprises a lateral surface, a bottom and a handle (12), said basket being formed from at least a sheet provided with a plurality of folding lines, and it is characterized in that said handle extends downwardly into a partition (11) which divides the basket into two housings. Said partition (11) is preferably joined to the bottom of the basket. It is obtained a very light basket, and which occupies a reduced space if transported in its unfolded position, with a great strength and suitable to transport heavy products, such as bottles.

19 Claims, 7 Drawing Sheets

BASKET

This application is a national phase entry under 35 U.S.C. §371 of International Application No. PCT/EP2007/053537, filed Apr. 12, 2007, hereby incorporated by reference, which itself claims priority to Spanish Patent Application No. U-200600855, filed Apr. 12, 2006, hereby incorporated by reference.

The present invention refers to a basket, comprising a handle, and especially suitable to transport food.

BACKGROUND OF THE INVENTION

There are known baskets for a long time which are used to transport products, such as food, which are provided with a handle to facilitate its transportation.

These baskets are especially suitable to be used in outdoors meals, such as in the country or in a ship, because they are especially designed to transport food.

The baskets actually known are rigid, i.e. they can not be folded before or after their use, which involves that they occupy a considerable space even if they are empty. Furthermore, because of their cost, they can not be discarded after a single use.

DESCRIPTION OF THE INVENTION

With the basket of the invention said drawbacks are solved, presenting other advantages that will be described.

The basket of the present invention comprises a lateral surface, a bottom and a handle, said basket being formed from at least a sheet provided with a plurality of folding lines, and it is characterized in that said handle extends downwardly into a partition which divides the basket into two housings.

Thanks to this feature, it is obtained a very light basket, and it occupies a reduced space if transported in its unfolded position, with a great strength and suitable to transport heavy products, such as bottles.

Advantageously, said partition is joined to the bottom of the basket, providing to the basket of the present invention a great strength.

Furthermore, each housing can comprise a closing flap to prevent the accidental exit of the products from the basket.

Advantageously, each closing flap comprises at least a hole, to permit to place inside the basket products with a greater height, such as bottles, whose neck will protrude through said holes.

According to a preferred embodiment, said handle and its partition are formed by two central flaps, each one provided with a pair of protrusions, which are inserted inside grooves provided at the lateral surface of the basket. Therefore, the handle and the partition have a great strength, and the basket can be used with a heavy weight, suitable with the use of the basket.

According to a first embodiment, the basket of the present invention is formed from only a sheet comprising:

- a pair of first sectors and a pair of second sectors joined to each other by joining sectors, defining the lateral surface of the basket;
- a pair of lower sectors, each one joined to a second sector, defining the bottom of the basket;
- four lower flaps, each one joined to one of said first sectors and to a lower sector, which are placed on the bottom of the basket, in its use position;
- two closing flaps joined, each one, to one of said second sectors in a position opposed to the lower sectors; and

- two central flaps joined to said lower sectors, defining the partition separating the basket into two housings and the handle.

According to a second embodiment, the basket is formed from two identical sheets joined to each other, each one of said sheet comprising:

- a first sector and a second sector joined to each other by joining sectors, defining the lateral surface of the basket together with the first and the second sectors of the other sheet;
- a lower sector, each one joined to a second sector, defining the bottom of the basket together with the lower sector of the other sheet;
- two lower flaps, each one joined to said first sector and to a lower sector, which are placed on the bottom of the basket, in its use position;
- a closing flap joined to said second sector in a position opposed to the lower sectors; and
- a central flap joined to said lower sectors, defining the partition separating the basket into two housings and the handle together with the central flap of the other sheet.

Preferably, said grooves are provided, each one, at one of said first sectors.

The basket of the present invention is preferably made from cardboard or plastic material.

If wished said partition can comprise a hole to communicate both housing to each other, permitting a better placement of the contents of the basket.

Furthermore, the basket of the present invention also can comprise at least an internal partition to divide at least one of said housings.

If wished, the lateral surface of the basket of the present invention comprises at least a hole to see inside the basket.

Thanks to the reduced cost of the basket of the present invention, if the user wants, he/she can dispose it even thought it was used only once.

BRIEF DESCRIPTION OF THE DRAWINGS

For a better understanding that has been described some drawings are attached in which, diagrammatically and only as a non-limitative example, a practical case of embodiment is shown.

DESCRIPTION OF PREFERRED EMBODIMENTS

Figure 1:
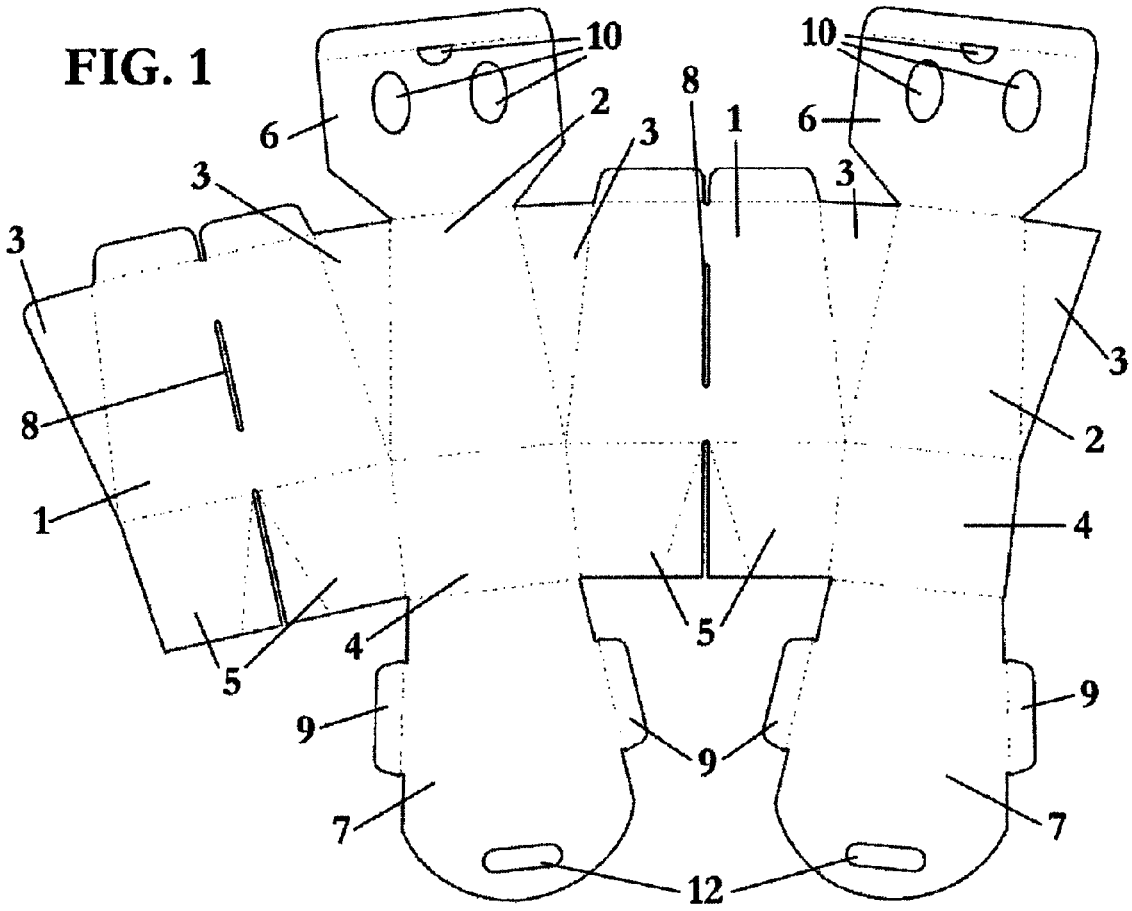
FIG. 1 is a plan view of the sheet from which the basket of the present invention is formed, in an unfolded position.

In FIG. 1 it is shown the sheet which forms the basket of the present invention, which can be from cardboard or plastic material.

This sheet comprises a plurality of folding lines defining:

a pair of first sectors 1 and a pair of second sectors 2 joined to each other by joining sectors 3, defining the lateral surface of the basket;

a pair of lower sectors 4, each one joined to a second sector 2, defining the bottom of the basket;

four lower flaps 5, each one joined to one of said first sectors 1 and to a lower sector 4, which are placed on the bottom of the basket, in its use position;

a pair of closing flaps 6 joined, each one, to one of the second sectors 2 in a position opposed to the lower sectors 4; and a pair of central flaps 7 joined to the lower sectors 4, defining a dividing partition 11 which divides the basket into two housings and a handle 12, as will be described hereinafter.

Each of the first sectors 1 comprises a groove 8, provided for housing protrusions 9 formed at the central flaps 7. It is illustrated in at least FIG. 1 and that each first sector 1 is formed having a trapezoidal shape with a top portion being more narrow than a bottom portion. Each second sector 2 is formed having a trapezoidal shape with a top part being more narrow than a bottom part. The pair of the first sectors 1 and the pair of the second sectors 2 joined to each other by joining sectors 3 to define the lateral surface. Each joining sector 3 is formed having substantially triangular configuration. Each central flap 7 is formed extending between a proximal end connected to the lower sector 4 and a distal end thereof, with the proximal end being more narrow than the distal end. A pair of protrusions 9 extends outwardly from the side portions of each central flap 7.

Furthermore, the closing flaps 6 comprise a series of holes 10, to permit said flaps to be opened and also to permit the products with a height greater than the height of the basket, such as bottles, e.g., to pass through them.

Figure 2:
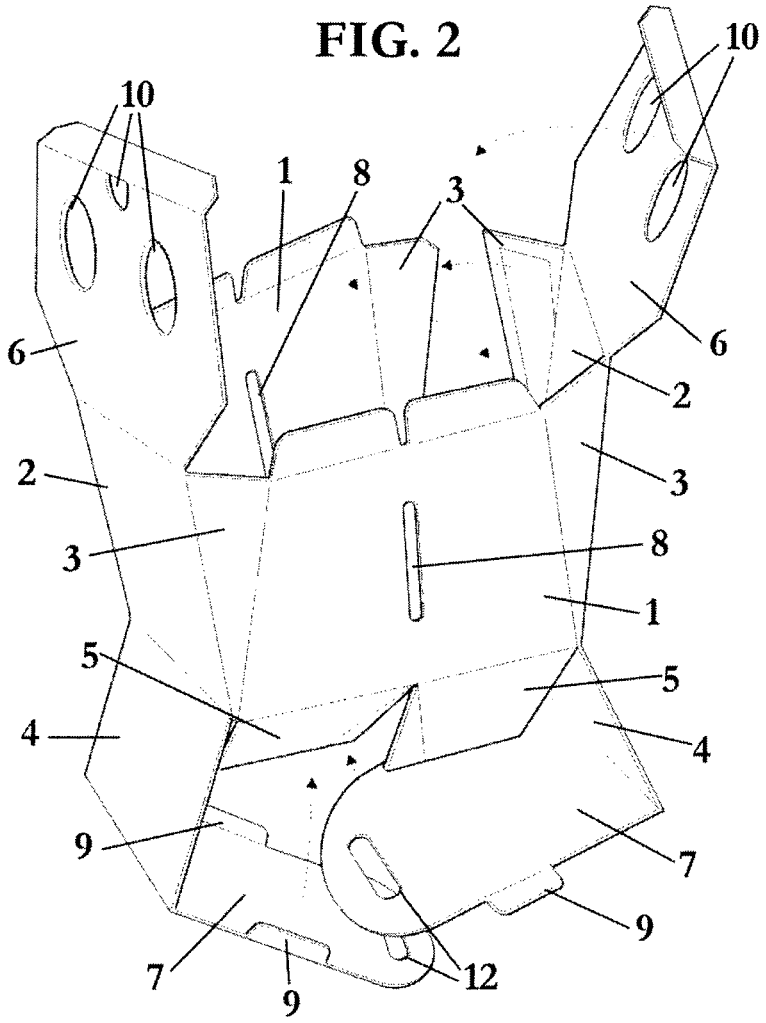
FIGS. 2 to 4 are perspective views of the assembly process of the basket of the present invention.
Figure 3:
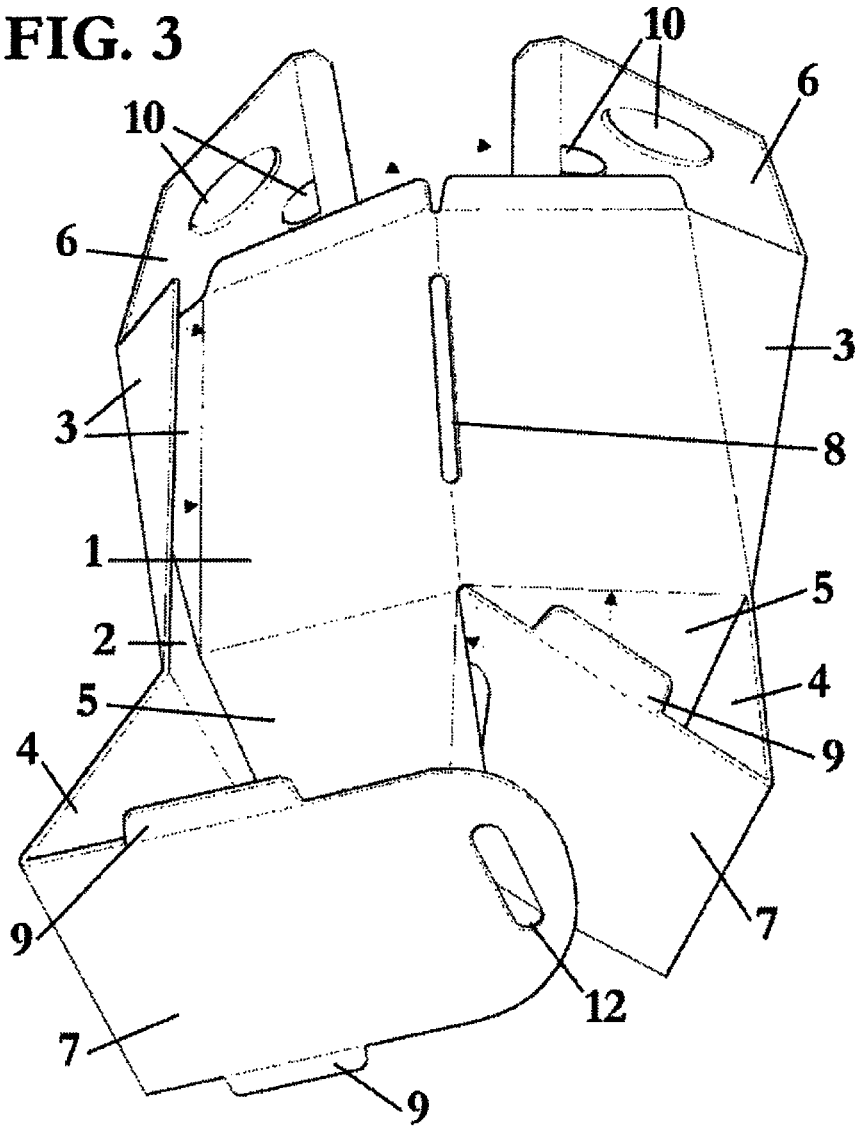

To mount the described sheet of FIG. 1, first both joining sectors 3 of the ends must the joined, as it can be been in FIGS. 2 and 3.

Then, the lower sectors 4 and the lower flaps 5 are folded and the central flaps 7 pass through the lower flaps 5 to form a central partition of the basket.

Once placed the central flaps 7 in their position, their protrusions 9 are housed inside the grooves 8 provided at the first sectors 1.

Figure 4:
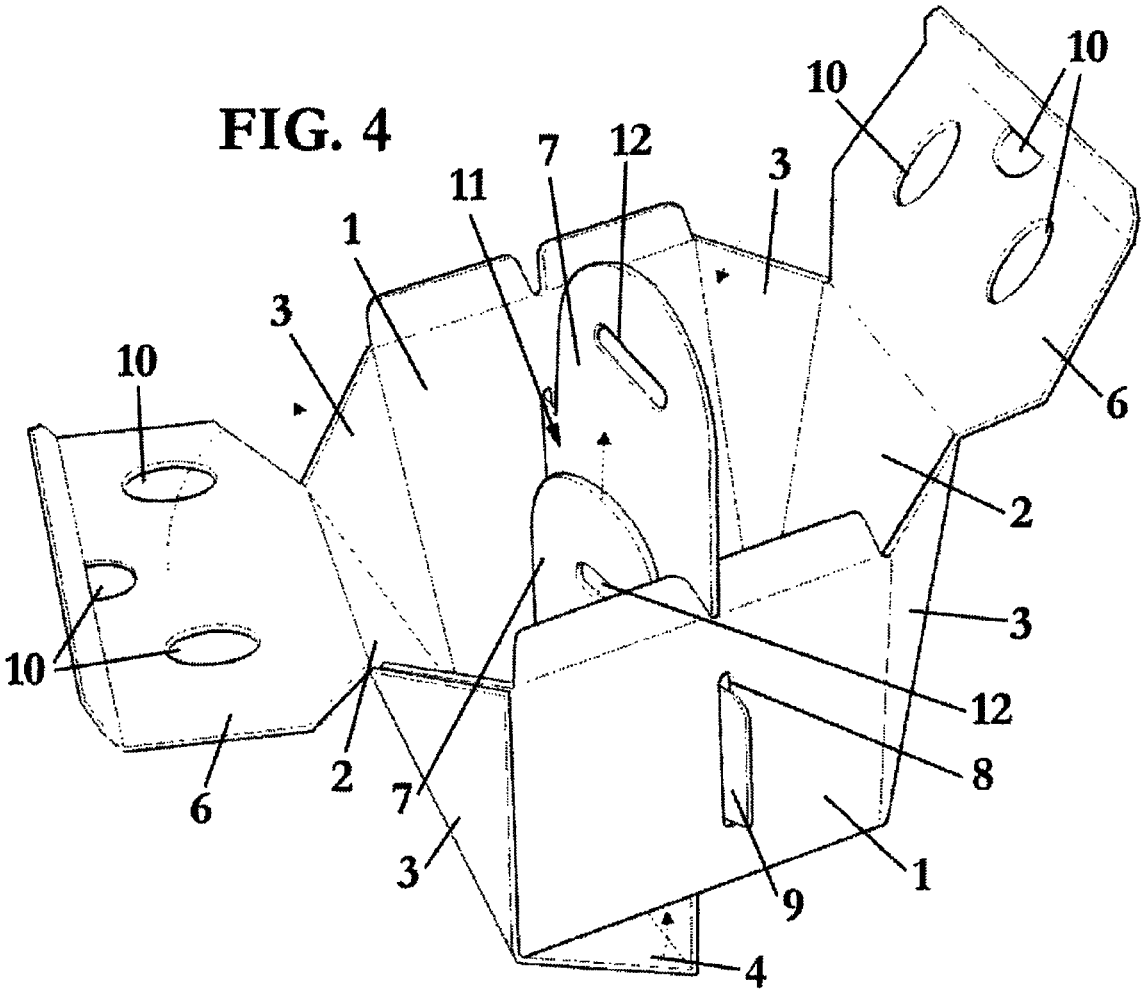
Figure 5:
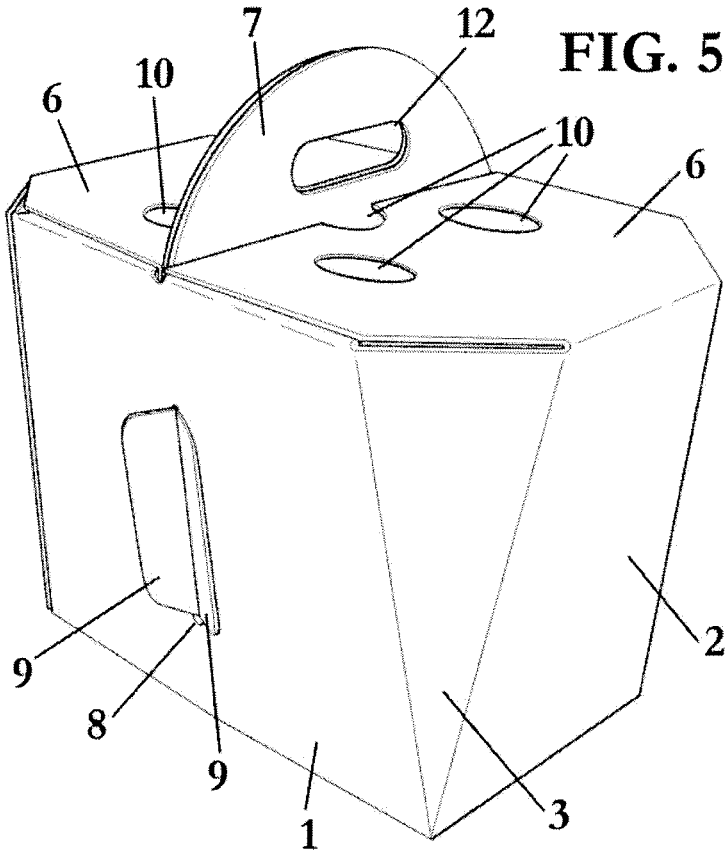
FIG. 5 is a perspective view of the basket of the present invention in its mounted position.

Finally, the closing flaps 6 are folded to close both housings, as it can be seen in FIG. 4. It must be pointed out that these closing flaps 6 are not essential, because they can be removed depending on the product which is to be transported with the basket of the present invention.

Therefore, it is obtained a basket provided with a central partition 11 with a handle 12 in its upper part, which separates the basket into two housings, which can be closed thanks to the closing flaps 6.

The basket can be transported with a heavy weight because the handle 12 is formed by two layers of material (both central flaps 7), which have a great strength, and also thanks to the fact that said central flaps 7 comprise the protrusions 9 which are housed inside the grooves 8.

Furthermore, the bottom of the basket has also a great strength thanks to the presence of three layers of material (the lower sector 4 and two lower flaps 5).

Figure 6:
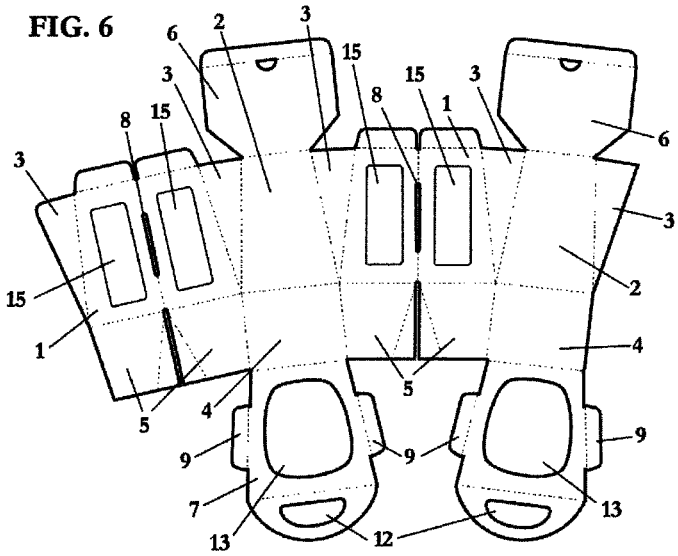
FIG. 6 is a plan view of the sheet from which the basket of the present invention is formed, in an unfolded position, according to a second embodiment.

In FIG. 6 is shown an alternative embodiment from that shown in the previous drawings. In this embodiment the only difference is the presence of holes 13 at the central flaps 7 and holes 15 at the first sectors 1.

The holes 13 permit to distribute better the contents of the basket, and any product can be placed crossing the central partition 11.

The holes 15 permit to see inside the basket. If wished, these holes 15 can be closed with transparent sheet material not preventing to see inside the basket, but permitting to isolate the contents of the basket from the outside.

Figure 7:
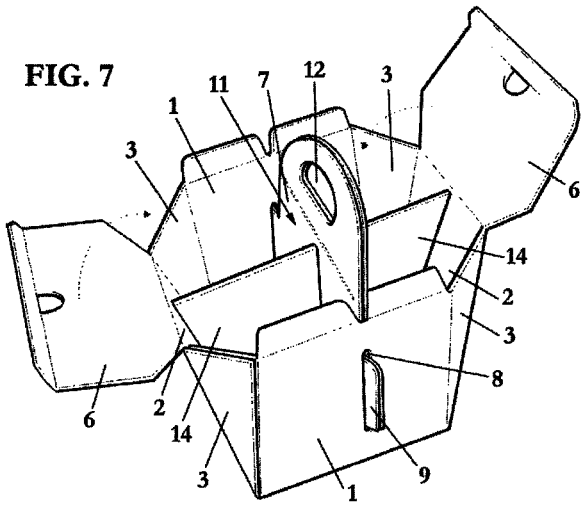
FIG. 7 is a perspective view of the basket of the present invention with the lips opened, and internal partitions can be seen.

In FIG. 7 is shown the basket of the present invention provided with additional internal partitions 14 to divide the basket into different housings.

It must be pointed out that inside the basket some suitable accessories can be placed taking into account the products to be transported. E.g., it could be placed horizontally a sheet with holes to place bottles.

Figure 8:
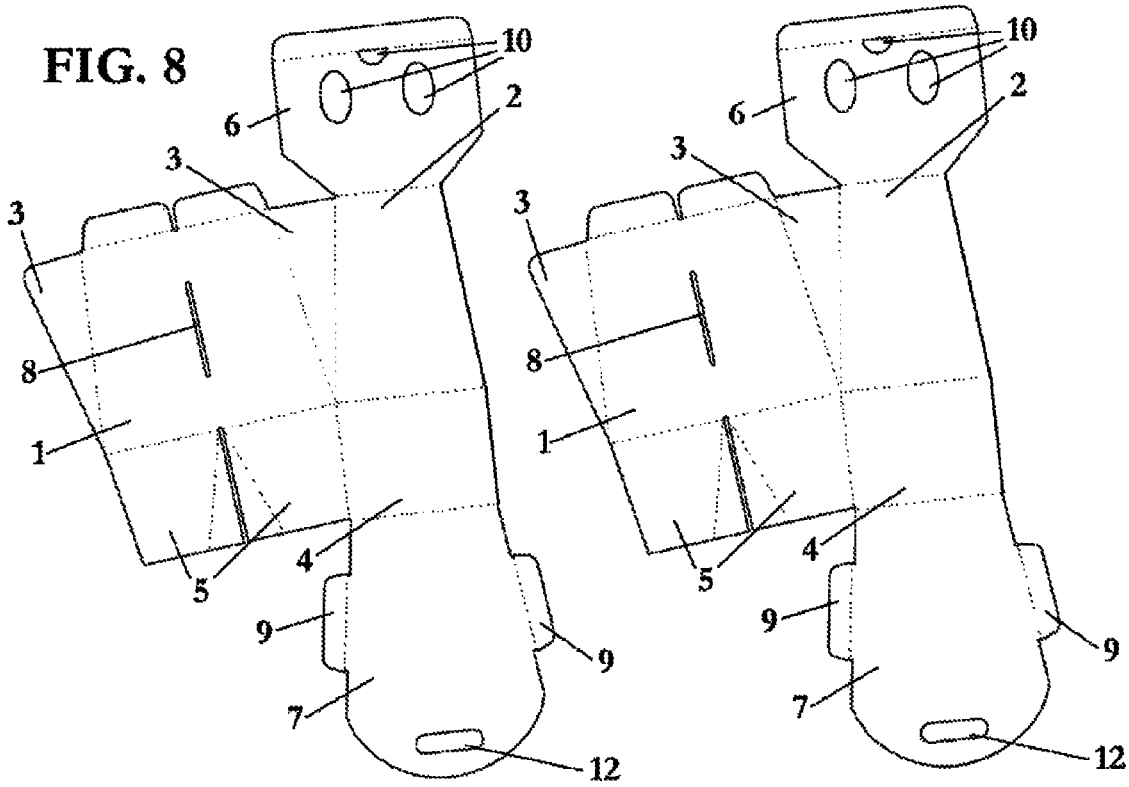
FIG. 8 is a plan view of a sheet, the basket of the present invention being formed from two of these sheets joined together, according to an alternative embodiment.

Finally, in FIG. 8 it is shown an alternative embodiment of the sheet forming the basket of the present invention shown in FIG. 1. In this case he sheet is divided in two, and it can be seen that both sheets are identical and, the joining of both sheets results in the sheet shown in FIG. 1.

Even though reference is made to an specific embodiment of the invention, it is apparent for a person skilled in the art that the described basket is susceptible of numerous variations and modifications, and that all the details mentioned can be substituted by other technically equivalent ones, without departing from the scope of protection defined by the attached claims.

The invention claimed is:

1. A foldable sheet formable into a basket for transportation of heavy weight items comprising a lateral surface, a bottom and a handle, said foldable sheet comprising:

a plurality of folding lines;

a pair of substantial first sectors, each said first sector formed having a trapezoidal shape with a top portion being more narrow than a bottom portion, a pair of second sectors, each said second sector formed having a trapezoidal shape with a top part being more narrow than a bottom part, said pair of the first sectors and said pair of the second sectors joined to each other by joining sectors, each said joining sector formed having substantially triangular configuration, the pair of first sectors, the pair of second sectors and the joining sectors defining the lateral surface of the basket;

a pair of lower sectors, each said lower sector joined to one of said second sectors, the lower sectors defining the bottom of the basket;

a pair of central flaps, each said central flap extending between a proximal end connected to the lower sector and a distal end, with the proximal end being more narrow than the distal end, said proximal end joined to the lower sector at a respective folding line, a pair of side portions connecting the proximal and distal ends, a pair of protrusions extending outwardly from the side portions, said central flaps defining a partition separating the basket into two housings, the handle is formed by a part of the partition situated outside of the housings; and grooves extending longitudinally through said first sectors, said grooves disposed in central regions of said first sectors and spaced from the folding lines defining said first sectors, said protrusions being inserted into and extending outwardly from said grooves when the basket is in use.

2. The foldable sheet according to claim 1, wherein the foldable sheet is comprised of cardboard or plastic material.

3. The foldable sheet according to claim 1, wherein each said housing comprises a closing flap.

4. The foldable sheet according to claim 1, further comprising:

four lower flaps, each said lower flap joined to one of said first sectors and three of the four lower flaps joined to one of said lower sectors, wherein the lower flaps are positioned at the bottom of the basket when the basket is in its use position; and two closing flaps, each said closing flap joined to one of said second sectors at an edge forming the top part disposed opposite to the lower sectors.

5. A basket for transportation of heavy weight items, said basket comprising:

a lateral surface, a bottom and a handle, said basket being formed from at least one sheet provided with a plurality of folding lines, said handle extending downwardly into a partition, so as to divide the basket into two housings, said partition is joined to the bottom of the basket by a folding line;

a pair of substantial first sectors, each said first sector formed having a trapezoidal shape with a top portion being more narrow than a bottom portion, a pair of second sectors, each said second sector formed having a trapezoidal shape with a top part being more narrow than a bottom part, said pair of substantial first sectors and said pair of second sectors joined to each other by joining sectors, each said joining sector formed having a substantially triangular configuration, the pair of first sectors, the pair of second sectors and the joining sectors defining the lateral surface of the basket;

a pair of lower sectors, each said lower sector joined to one of said second sectors, the lower sectors defining the bottom of the basket; a pair of central flaps, said central flaps defining the partition and the handle, each said central flap having a proximal end and a distal end, with the proximal end being more narrow than the distal end, said proximal end joined to the lower sector at a respective folding line, side portions extending between the proximal and distal ends, a pair of protrusions extending outwardly from the side portions, and grooves extending longitudinally through approximately a half of each said substantial first sector, said grooves disposed in central regions of said first sectors and spaced from the folding lines defining said first sectors, said protrusions being inserted into and extending outwardly from said grooves when the basket is in an assembled position, whereby while the basket containing heavy weight items is carried by means of said handle, forces of gravity produced by the heavy weight items positioned at the bottom of the basket within said housings and surrounded by the bottom portions of the first sectors and the bottom parts of the second sectors are directed downwardly, so said partition and said central flaps pull upwardly said protrusions within said grooves in the directions of said narrow top portions of the first sectors and the top parts of the second sectors enhancing mutual engagement, and resulted in the basket of greater strength.

6. The basket according to claim 5, wherein each housing comprises a closing flap.

7. The basket according to claim 6, wherein each closing flap comprises at least one hole.

8. The basket according to claim 6, wherein the basket formed from said at least one sheet further comprising:

four lower flaps, each said lower flap joined to one of said first sectors and three of the four lower flaps joined to one of said lower sectors, wherein the lower flaps are positioned on the bottom of the basket when the basket is in its use position; and each said closing flap joined to one of said second sectors at an edge opposite to the lower sectors.

9. The basket according to claim 5, wherein said at least one sheet comprises two substantially identical sheets joined to each other, each said sheet comprising:

the first sectors and the second sectors joined to each other by the joining sectors, defining the lateral surface of the basket together with the first and the second sectors of the other sheet;

the lower sectors defining the bottom of the basket together with the lower sectors of the other sheet;

two lower flaps, each said lower flap joined to said first sector and to one of said lower flaps joined to said lower sector, wherein the lower flaps are positioned at the bottom of the basket when the basket is in its use position;

a closing flap joined to said second sector at an edge forming the top part disposed opposite to the lower sectors; and the central flaps together with central flaps of the other sheet defining the partition separating the basket into two housings and the handle.

10. The basket according to claim 9, wherein said two substantially identical sheets are comprised of cardboard or plastic material.

11. The basket according to claim 5, wherein said at least one sheet is comprised of cardboard or plastic material.

12. The basket according to claim 5, wherein said partition comprises a hole connecting both housings to each other.

13. The basket according to claim 5, further comprising at least one internal partition dividing at least one of said housings.

14. The basket according to claim 5, wherein the lateral surface of the basket comprises at least one hole.

15. The basket according to claim 5, wherein a cross section of the basket at a top is smaller than a cross section thereof at a bottom of the basket.

16. The basket according to claim 5, wherein the handle is formed within the central flap at said distal end thereof, the protrusions extend outwardly from the side portions and joined to said sides by side folding lines.

17. The basket according to claim 5, wherein, in the assembled condition said protrusions are folded toward the respective first sectors, to prevent accidental release of said protrusions from the grooves.

18. A basket for transportation of heavy weight items, said basket comprising:

a lateral surface, a bottom and a handle, said handle extending downwardly into a partition, so as to divide the basket into two housings;

a pair of first sectors, each said first sector formed having a trapezoidal shape with a top portion being more narrow than a bottom portion, a pair of second sectors, each said second sector formed having a trapezoidal shape with a top part being more narrow than a bottom part, said pair of the first sectors and said pair of the second sectors joined to each other by joining sectors to define the lateral surface, each said joining sector formed having substantially triangular configuration;

a pair of lower sectors connecting the pair of second sectors and a pair of central flaps, the lower sectors defining the bottom of the basket;

said central flaps defining the partition and the handle, each said central flap extending between a proximal end and a distal end thereof, with the proximal end being more narrow than the distal end, said proximal end of each said central flap joined to the lower sector at a respective folding line, a pair of side portions connecting the proximal and distal ends, a pair of protrusions extending outwardly from the side portions; and grooves extending longitudinally through each said first sector, said grooves disposed in central regions of said first sectors and spaced from the folding lines defining said first sectors, said protrusions being inserted into and extending outwardly from said grooves when the basket is in an assembled position, wherein while the basket containing heavy weight items is carried by means of said handle, forces of gravity produced by the heavy weight items positioned at the bottom of the basket and surrounded by the bottom portions of the first sectors and the bottom parts of the second sectors are directed downwardly, so said partition and said central flaps pull upwardly said protrusions within said grooves in the directions of the narrow top portions of the first sectors and the narrow top parts of the second sectors enhancing mutual engagement, and resulted in the basket of greater strength.

19. The basket according to claim 18, wherein a cross section of the basket at a top is smaller than a cross section thereof at a bottom of the basket.

* * * * *